US008968033B2

(12) United States Patent
Little

(10) Patent No.: US 8,968,033 B2
(45) Date of Patent: Mar. 3, 2015

(54) ELECTRICAL CONNECTOR AND INTERFACE THEREOF

(71) Applicant: Hon Hai Precision Industry Co., Ltd., New Taipei (TW)

(72) Inventor: Terrance F. Little, Fullerton, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 110 days.

(21) Appl. No.: 13/872,132

(22) Filed: Apr. 28, 2013

(65) Prior Publication Data

US 2013/0288524 A1 Oct. 31, 2013

Related U.S. Application Data

(60) Provisional application No. 61/639,873, filed on Apr. 28, 2012.

(51) Int. Cl.

| | |
|---|---|
| ***H01R 24/00*** | (2011.01) |
| ***H01R 13/6581*** | (2011.01) |
| *H01R 24/60* | (2011.01) |
| *H01R 107/00* | (2006.01) |

(52) U.S. Cl.

CPC ..... *H01R 13/6581* (2013.01); *H01R 24/60* (2013.01); *H01R 2107/00* (2013.01)

USPC ..... 439/660; 439/607.35

(58) Field of Classification Search

USPC ..... 439/607.35–607.57, 660, 677, 680, 374

See application file for complete search history.

(56) References Cited

U.S. PATENT DOCUMENTS

| | | | | |
|---|---|---|---|---|
| 6,039,606 | A * | 3/2000 | Chiou | 439/607.45 |
| 7,252,549 | B2 * | 8/2007 | Nishio et al. | 439/607.55 |
| 7,267,579 | B1 * | 9/2007 | Wu | 439/607.57 |
| 8,241,064 | B2 * | 8/2012 | Ohtsuji et al. | 439/607.01 |
| 8,303,344 | B2 * | 11/2012 | Xiao et al. | 439/607.56 |
| 8,475,211 | B2 * | 7/2013 | Wang et al. | 439/607.38 |
| 2005/0048839 | A1 * | 3/2005 | Zhang | 439/607 |
| 2006/0019545 | A1 * | 1/2006 | Moriyama et al. | 439/660 |
| 2009/0117754 | A1 * | 5/2009 | Fields et al. | 439/55 |
| 2009/0124134 | A1 * | 5/2009 | Moriyama et al. | 439/660 |
| 2009/0325417 | A1 * | 12/2009 | Ko | 439/350 |
| 2010/0003854 | A1 * | 1/2010 | Wang et al. | 439/607.57 |
| 2010/0062642 | A1 * | 3/2010 | Zhang et al. | 439/607.41 |
| 2010/0087098 | A1 * | 4/2010 | Sloey et al. | 439/660 |
| 2010/0227504 | A1 * | 9/2010 | Wang et al. | 439/607.41 |

* cited by examiner

*Primary Examiner* — Gary Paumen

(74) *Attorney, Agent, or Firm* — Wei Te Chung; Ming Chieh Chang

(57) ABSTRACT

An assembly includes a receptacle and a plug. The plug comprises a plug insulative housing with a front mating region, a plurality of plug contacts disposed in the housing with plug contacting sections exposed upon the mating region and a plug metallic shell enclosing the front mating region to commonly define a plug mating port. The plug metallic shell defines essentially a rectangular cross-section including two opposite long sides and two opposite short sides perpendicular to each other. A pair of chamfered structures is formed on two opposite corners along one of the two long sides, and a centered recessed area is formed on the other of said two long sides. The front mating region intimately abuts against the other of the two long sides. The receptacle has a receptacle metallic shell with a similar contour of the plug metallic shell.

15 Claims, 8 Drawing Sheets

ELECTRICAL CONNECTOR AND INTERFACE THEREOF

CROSS REFERENCE TO RELATED APPLICATIONS

This application claims the benefit of, and priority to, U.S. Provisional Patent Application No. 61/639,873, filed Apr. 28, 2012, the contents of which are incorporated entirely herein by reference.

BACKGROUND OF THE INVENTION

1. Field of the Invention

The present invention relates to an electrical connector assembly, and more particularly to the corresponding receptacle and plug and the interfaces thereof 2. Description of Related Art A so-called c-Link connector requires a new interface for differentiation from the currently existing HDMI Type C connector having two chamfered structure on two opposite bottom corners of the mating port and DiiVA connector having a recessed area on an underside of the mating port, thus preventing mis-match.

In addition, robustness is desired to resist improper bending for miniaturization of the connector.

SUMMARY OF THE INVENTION

Accordingly, an object of the present invention is to provide an electrical connector assembly including a receptacle and a plug. The plug comprises a plug insulative housing with a front mating region, a plurality of plug contacts disposed in the housing with plug contacting sections exposed upon the mating region and a plug metallic shell enclosing the front mating region to commonly define a plug mating port. The plug metallic shell defines essentially a rectangular cross-section including two opposite long sides and two opposite short sides perpendicular to each other. Wherein a pair of chamfered structures is formed on two opposite corners along one of the two long sides, and a centered recessed area is formed on the other of said two long sides. The front mating region intimately abuts against the other of the two long sides. The receptacle comprises a receptacle insulative housing with a front mating tongue thereof, a plurality of receptacle contacts disposed in the receptacle housing with receptacle contacting sections exposed upon the front mating tongue and a receptacle metallic shell enclosing the front mating tongue to commonly define a receptacle mating port. Wherein the contour of the receptacle metallic shell is similar to that of the plug metallic shell and adapted to intimately and compliantly surround the plug metallic shell during mating under condition that the mating tongue is sandwiched between the mating region and the plug metallic shell.

Other objects, advantages and novel features of the invention will become more apparent from the following detailed description when taken in conjunction with the accompanying drawings.

DETAILED DESCRIPTION OF THE PREFERRED EMBODIMENT

Figure 1:
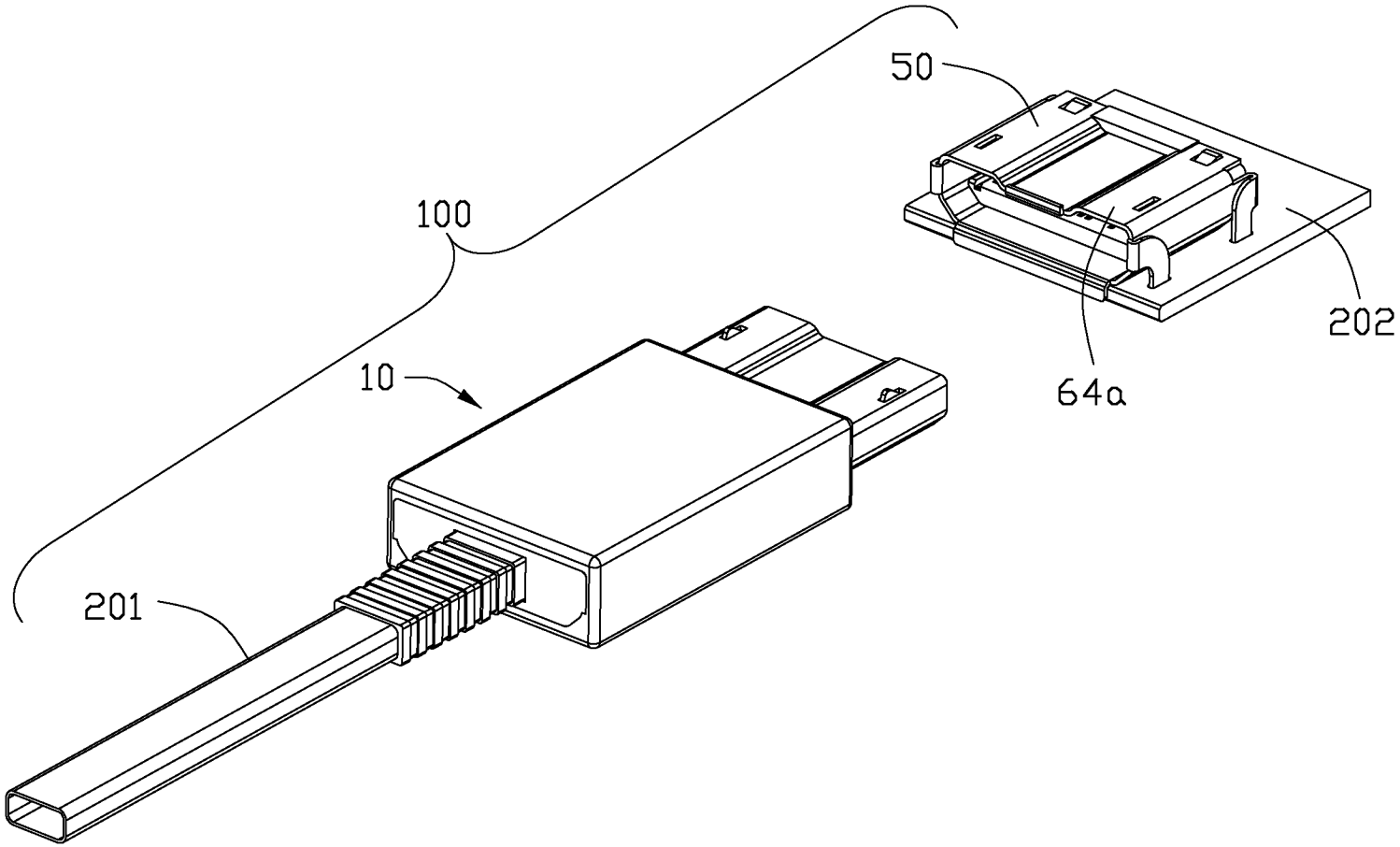
FIG. 1 is an exploded perspective view showing an electrical connector assembly having the plug and the receptacle of a first embodiment in accordance with the present invention.

Reference will now be made in detail to the preferred embodiment of the present invention.

Referring to FIGS. 1-4, an electrical connector assembly 100 includes a plug 10 connecting with a cable 201 and a receptacle 50 mounted on a printed circuit 202. The plug 10 includes a plug insulative housing 12 with a front mating region 14. A plurality of plug contacts 16 are disposed in the plug housing 12 with plug contacting sections 18 exposed upon the mating region 14. A plug metallic shell 20 encloses the mating region 14 to commonly form a plug mating port 22. The plug metallic shell 20 defines essentially a rectangular cross-section including two opposite long sides 24 and two opposite short sides 26 perpendicular to each other wherein a pair of chamfered structures 28 are formed on two opposite corners 27 of the lower long side 24*b* with the short side 26*a*, 26*b* while a centered recessed area 30 is formed on the upper long side 24*a*. A pair of deflectable/retractable latches 32 is located on two lateral side regions 34 of the plug mating port 22 beside the recessed area 30. It is noted that the pair of latches 32 are essentially close to the chamfered structures 28 in a top view so as to maximize the contact amount available in the plug 10.

The receptacle 50 is surrounded with a receptacle metallic shell 60. A recessed area 70 is defined on an upper long side 64*a* for snugly and compliantly receiving the plug metallic shell 20 therein. A flange 76 is defined at a front edge of the recessed area 70 to guide and shielding the plug shell 20.

Figure 2:
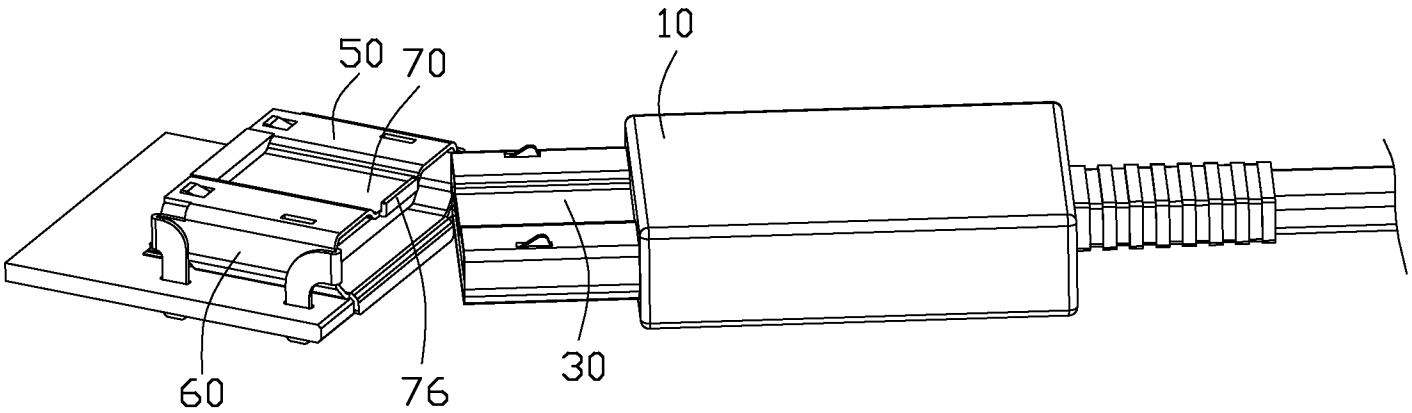
FIG. 2 is an enlarged partial exploded perspective view showing the connector assembly of FIG. 1 ready for mating.
Figure 3:
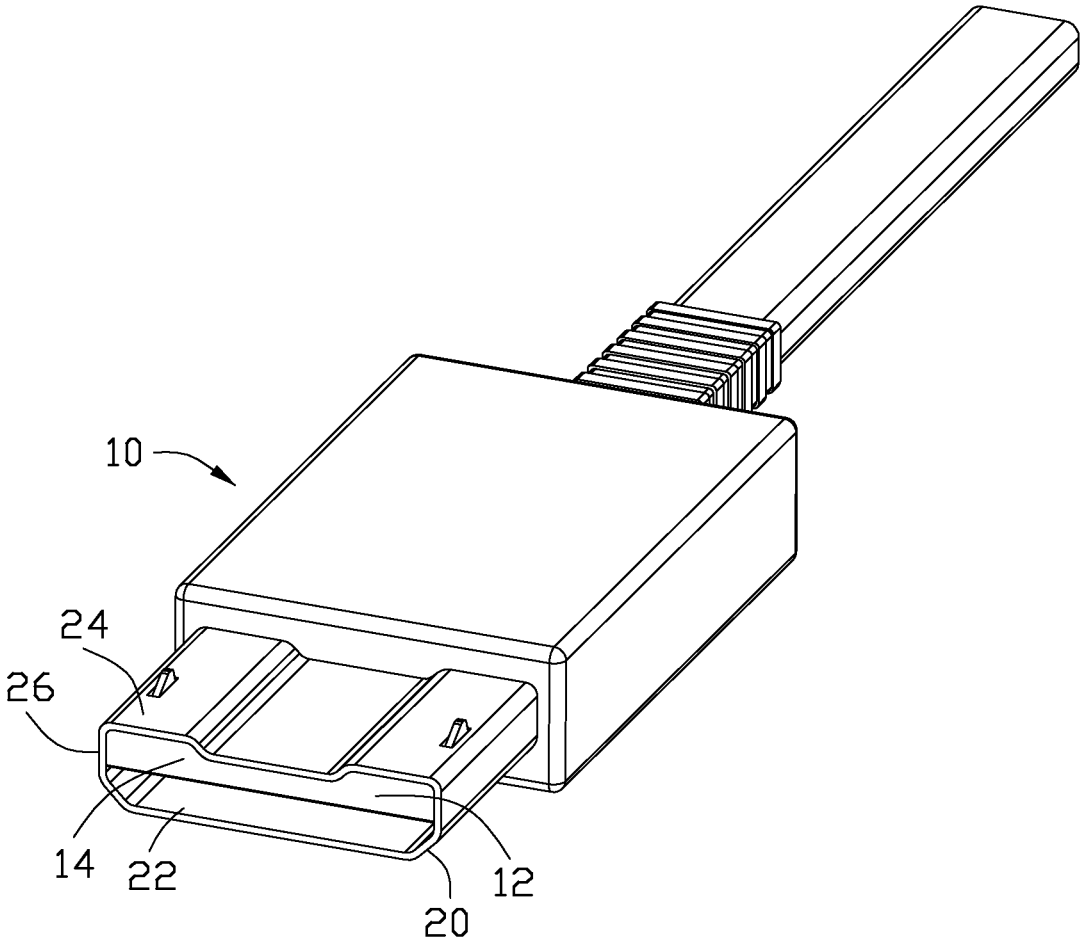
FIG. 3 is a perspective view showing the plug of FIG. 1.
Figure 4:
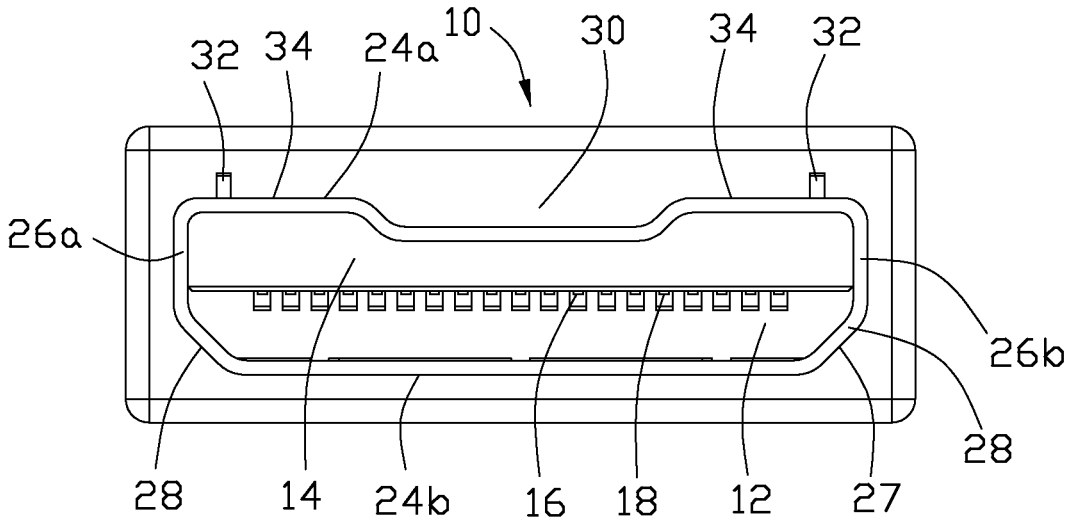
FIG. 4 is a front elevational view showing the plug of FIG. 3.
Figure 5:
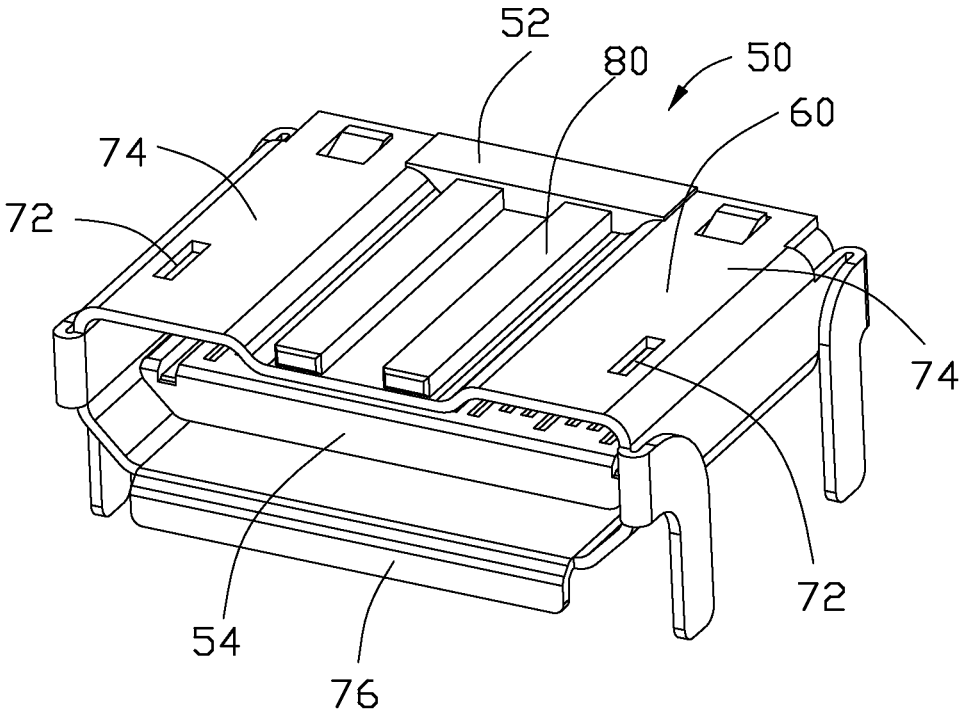
FIG. 5 is a perspective view to show a receptacle similar to the receptacle of FIG. 1 and further equipped with the light pipes in the recessed area.
Figure 6:
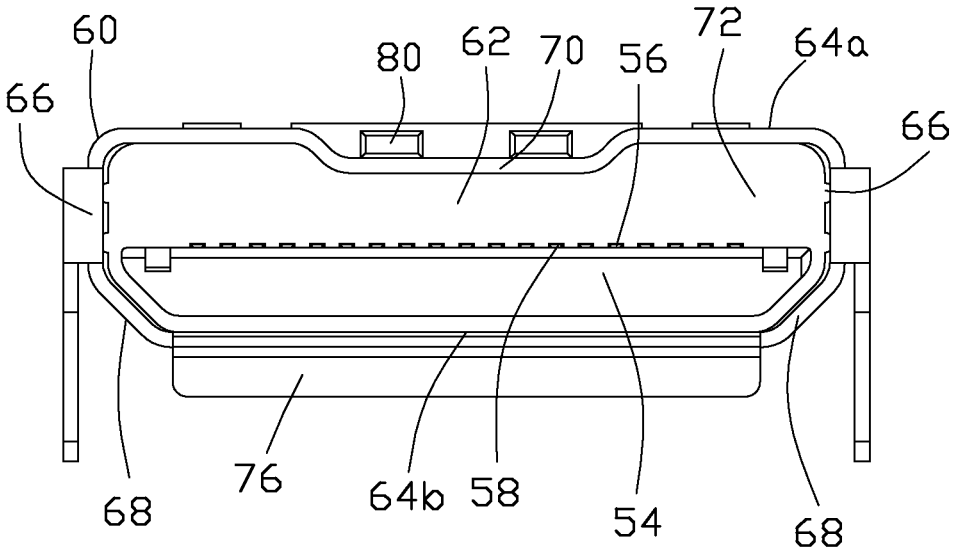
FIG. 6 is a front elevational view to show the receptacle of FIG. 5.

Referring further to FIGS. 5-6 show a receptacle similar to the receptacle of FIG. 1 and further equipped with the light pipes 80 in the recessed area. The receptacle is designated to mate with the plug showing in FIGS. 1-4, so the receptacle is labeled with same references to that in FIGS. 1-4. The receptacle 50 includes a receptacle housing 52 with a front mating tongue 54. A plurality of receptacle contacts 56 are disposed in the receptacle housing 52 with receptacle contacting sections 58 exposed upon the mating tongue 54. A receptacle metallic shell 60 encloses the mating tongue 54 to commonly define a receptacle mating port 62 wherein a contour of the receptacle metallic shell 60 is similar to that of the plug metallic shell 20 and includes two opposite long sides 64 and two opposite short sides 66 with a pair of chamfered structures 68 on two opposite corners along the lower long side 64*b* and a recessed area 70 on the upper long side 64*a* for snugly and compliantly receiving the plug metallic shell 20 therein under condition that the mating tongue 54 is sandwiched between the mating region 14 and the lower long side 24 of the plug metallic shell 20. The upper long side 64 is further equipped with a pair of locking holes 72 on two lateral side regions 74 of the receptacle mating port 62. Referring to FIGS. 1 and 2, the flanges 76 is formed on the front edge of the receptacle metallic shell 60 in alignment with the recessed area 70 for guiding and shielding. Referring to FIGS. 5 and 6, without the flange structure on the front edge, a pair of light pipes 80 extends on the recessed area 70 for communication with an exterior.

Figure 7:
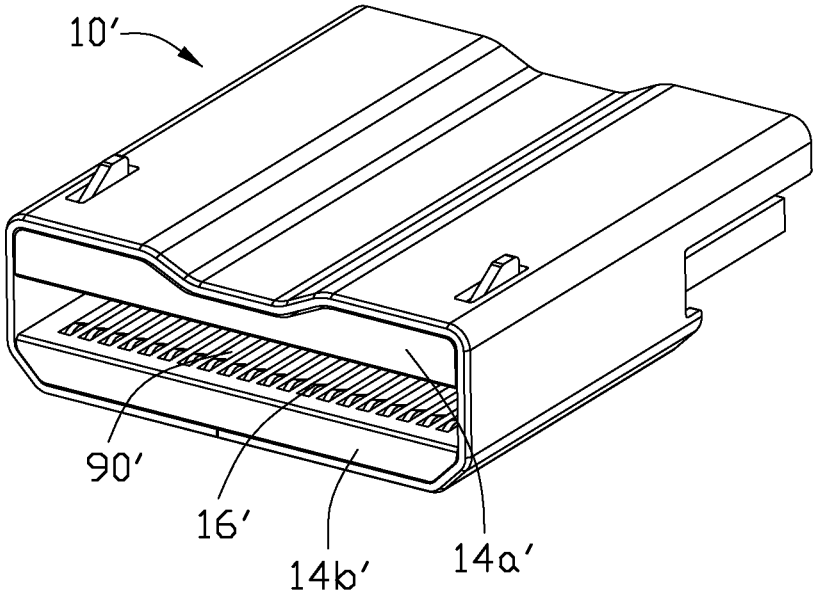
FIG. 7 is a perspective view of another embodiment of a plug of the present invention.
Figure 8:
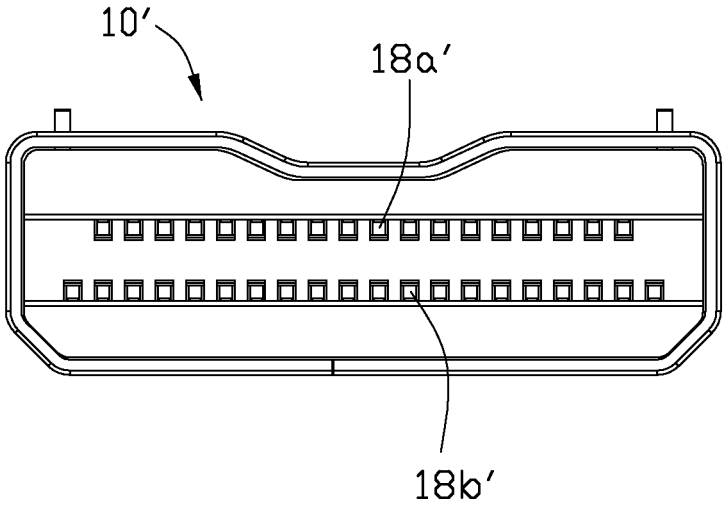
FIG. 8 is a front elevational view of the plug of FIG. 7.

Referring to FIGS. 7 and 8, the plug 10' defines a mating cavity 90' in the middle level with two rows of contacts 16' by two sides in the vertical direction in comparison with the mating cavity 90' at the lower level in the first embodiment shown in FIGS. 1-4. The receptacle insulating housing defines two front mating regions 14*a*', 14*b*' and contacting sections 18*a*', 18*b*' of the two rows contacts 16' are exposed upon said two mating regions 14*a*', 14*b'*.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly comprising:

a plug comprising:

a plug insulative housing with a front mating region;

a plurality of plug contacts disposed in the housing with plug contacting sections exposed upon the mating region;

a plug metallic shell enclosing the front mating region to commonly define a plug mating port, the plug metallic shell defining essentially a rectangular cross-section including two opposite long sides and two opposite short sides perpendicular to each other;

wherein a pair of chamfered structures is formed on two opposite corners along one of the two long sides, and a centered recessed area is formed on the other of said two long sides, the front mating region intimately abuts against the other of the two long sides;

the receptacle intended for mating with the plug, the receptacle comprising:

a receptacle insulative housing with a front mating tongue thereof;

a plurality of receptacle contacts disposed in the receptacle housing with receptacle contacting sections exposed upon the front mating tongue;

a receptacle metallic shell enclosing the front mating tongue to commonly define a receptacle mating port;

wherein a contour of the receptacle metallic shell is similar to that of the plug metallic shell and adapted to intimately and compliantly surround the plug metallic shell during mating under condition that the mating tongue is sandwiched between the mating region and the plug metallic shell.

2. The electrical connector assembly as described in claim 1, wherein a guiding flange is formed a front edge of the receptacle metallic shell in alignment with the recessed area.

3. The electrical connector assembly as described in claim 1, wherein a pair of light pipes extends on the recessed area for communication with an exterior.

4. The electrical connector assembly as described in claim 1, wherein a pair of deflectable latches is located on two lateral side regions beside the recessed area of the plug mating port.

5. The electrical connector assembly as described in claim 4, wherein the pair of latches is essentially close to the chamfered structures in a top view so as to maximize contact amount available in the plug.

6. A plug connecting with a cable, the plug comprising:

an insulative housing with a first mating region;

a plurality of contacts disposed in the insulating housing with contacting sections exposed upon a first surface of the first mating region;

a metallic shell enclosing the mating region to commonly define a mating port, the metallic shell comprising two opposite long sides and two opposite short sides perpendicular to each other;

wherein a pair of chamfered structures is formed on two opposite corners along a first one of the two long sides, and a second one of the long sides intimately abuts against a second surface opposite to the first surface of mating region, the second one of said two long sides defines a centered recessed area thereon.

7. The plug as described in claim 6, wherein the insulating housing defines a second mating region opposite to the first mating region, the first one of said two long side intimately abuts against a first surface of the second mating region and a second surface opposite to the first surface of the second mating region is loaded with contacting sections of a plurality of contacts.

8. An electrical connector assembly comprising:

a receptacle including:

an insulative housing defining a front mating tongue;

a metallic shell attached to the housing and enclosing said mating tongue to define a mating port;

a plurality of contacts disposed upon the mating tongue and exposed in the mating port; and said metallic shell defining two opposite horizontal long sides and two opposite vertical short sides with a first pair of chamfered structures on two opposite corners of one of said two opposite horizontal long sides and the corresponding two opposite vertical short sides to commonly define said mating port; wherein the mating tongue defines a second pair of chamfered structures in spaced while intimate confrontation and compliance with the first pair of chamfered structure.

9. The electrical connector assembly as claimed in claim 8, wherein the other of said two opposite horizontal long sides defines an inward recessed area in a center region.

10. The electrical connector assembly as claimed in claim 9, wherein at least one light pipe is positioned on an exterior surface of said recessed area, and a height of said light pipe is not beyond an exterior surface of said other of the two opposite horizontal long sides.

11. The electrical connector assembly as claimed in claim 9, wherein said shell defines a pair of through holes in said other of the horizontal long sides and by two sides of the inward recessed area for locking.

12. The electrical connector assembly as claimed in claim 8, wherein said mating tongue defines essentially a trapezoidal cross-section.

13. The electrical connector assembly as claimed in claim 8, further including a plug including another insulative housing with a front mating region enclosed in another metallic shell to define a trapezoid like cavity to receive said mating tongue.

14. The electrical connector assembly as claimed in claim 13, wherein said another housing defines another inward recessed area in a center region, and said another shell defines another inward recessed area in a center region to not only be compliantly received in the inward recessed area of said another housing of the plug but also compliantly receive the inward recessed area of the metallic shell of the receptacle.

15. The electrical connector assembly as claimed in claim 14, wherein said plug is equipped with a pair of latches by two sides of the inward recessed area of said another shell.

* * * * *